252-104 AU 166 EX
9/1/81 OR 4,287,080

United States Patent [19]

Siklosi

[11] 4,287,080

[45] Sep. 1, 1981

[54] DETERGENT COMPOSITIONS WHICH CONTAIN CERTAIN TERTIARY ALCOHOLS

[75] Inventor: Michael P. Siklosi, Cincinnati, Ohio

[73] Assignee: The Procter & Gamble Company, Cincinnati, Ohio

[21] Appl. No.: 76,002

[22] Filed: Sep. 17, 1979

[51] Int. Cl.[3] ..... C11D 7/54; C11D 7/50

[52] U.S. Cl. ..... 252/104; 252/111; 252/114; 252/122; 252/139; 252/153; 252/162; 252/540; 252/559; 252/DIG. 1; 252/DIG. 7; 252/DIG. 10; 252/DIG. 13; 252/DIG. 14

[58] Field of Search ..... 252/104, 111, 114, 122, 252/139, 153, 162, 540, 559, DIG. 1, DIG. 7, DIG. 10, DIG. 13, DIG. 14

[56] References Cited

U.S. PATENT DOCUMENTS

| | | | |
|---|---|---|---|
| 3,095,381 | 6/1963 | Tinnon et al. | 252/161 |
| 3,130,169 | 4/1964 | Blumbergs et al. | 252/104 X |
| 3,248,336 | 4/1966 | Blumbergs | 252/104 X |
| 3,463,735 | 8/1969 | Stonebraker et al. | 252/162 |
| 3,558,508 | 1/1971 | Fijalkowski | 252/312 |
| 3,561,915 | 2/1971 | Matalon | 252/118 X |
| 3,679,609 | 7/1972 | Castner | 252/DIG. 10 |
| 3,696,143 | 10/1972 | Malhotra | 252/162 |
| 3,741,902 | 6/1973 | Barrett, Jr. | 252/DIG. 12 |
| 3,746,649 | 7/1973 | Barrett, Jr. | 252/170 |
| 3,776,851 | 12/1973 | Cheng | 252/174.12 |
| 3,813,343 | 5/1974 | Mukai | 252/DIG. 10 |
| 3,829,387 | 8/1974 | Wise et al. | 252/162 |
| 3,855,142 | 12/1974 | Pader | 252/DIG. 12 |
| 3,966,649 | 6/1976 | Cheng | 252/DIG. 14 |
| 3,997,481 | 12/1976 | Cheng | 252/DIG. 4 |
| 4,100,093 | 7/1978 | Rialdi | 252/DIG. 14 |

*Primary Examiner*—Mayer Weinblatt
*Attorney, Agent, or Firm*—Leonard Williamson; Ronald L. Hemingway; Richard C. Witte

[57] ABSTRACT

Detergent compositions are disclosed which comprise about 0.05% to 50% of a surfactant and 0.5% to 50% of a tertiary alcohol having at least 5 carbon atoms per molecule. The described combination has utility in a wide variety of different cleaning compositions to improve their cleaning performance. Certain of the preferred compositions employ low odor tertiary alcohols, tertiary alcohols which are stable with respect to oxidizing bleaches, and tertiary alcohols which are useful in solid compositions.

14 Claims, No Drawings

DETERGENT COMPOSITIONS WHICH CONTAIN CERTAIN TERTIARY ALCOHOLS

TECHNICAL FIELD

This invention relates to cleaning compositions containing any of the surfactants known to be useful for cleaning, and further containing a tertiary alcohol having at least 5 carbon atoms in its molecular structure. Specific cleaning compositions within the scope of the invention include solid or liquid abrasive cleansers, solid or liquid general purpose cleaning products, and dishwashing liquids.

BACKGROUND ART

It has long been recognized in the art that surfactants are highly desirable, in fact, almost essential, to effective cleaning performance by a cleaning composition. However, it has also been recognized that there is room for improvement in surfactant-based cleaning products.

Applicant is aware of a wide variety of surfactant-based cleaning compositions which contain tertiary butanol, used primarily for its physical ability to solubilize the detergent composition itself or as a solvent. Several representative references follow. U.S. Pat. No. 3,966,649, issued to Cheng on June 29, 1976, discloses the use of tertiary butanol in a heavy duty liquid laundry detergent composition to improve the stability of the composition and prevent gelling. U.S. Pat. No. 3,997,481, issued to Cheng on Dec. 14, 1976, provides a similar teaching. U.S. Pat. No. 3,463,735, issued to Stonebraker et al. on Aug. 26, 1969, discloses a hard-surface and glass cleaner which contains, among other things, 0.5% to 5% tertiary butanol and 0.05% to 0.5% of a surfactant in aqueous solution. U.S. Pat. No. 3,248,336, issued to Blumbergs on Apr. 26, 1966, discloses that tertiary butanol may be used to stabilize aqueous peroxybenzoic acid laundry bleaches. The specification teaches that such bleaches may be used in conjunction with the usual laundry detergents to wash and bleach clothes simultaneously.

The applicant has discovered one reference which teaches that a tertiary alcohol such as tertiary butanol may be used to treat a crude sulfonated or sulfated surfactant to remove inorganic salts from the surfactant. The surfactant is recovered from the treatment liquor after the operation is completed, however, so the combination of a tertiary alcohol and a surfactant is not taught to have any utility per se.

Applicant is aware of a reference which teaches the use of a tertiary alcohol to solubilize polyisopropylene gum, which is used as an ingredient of the disclosed composition. That patent is U.S. Pat. No. 4,100,093, issued to Rialdi on July 11, 1978.

U.S. Pat. No. 3,829,387, issued to Wise et al. on Aug. 13, 1974, discloses the optional use of 2-methyl-2, 4-pentanediol in an oven cleaning composition which also may include a surfactant. It will be recognized that this compound is not a tertiary alcohol, as defined hereinafter, because it contains a secondary alcohol moiety.

Finally, the following U.S. Patents are believed to be less relevant, and disclose the use of primary or secondary alcohols, or ones undifferentiated by degree, in detergent compositions. U.S. Pat. No. 3,679,609, issued to Castner on July 25, 1962, discloses a detergent concentrate containing lower alcohols and surfactants U.S. Pat. No. 3,741,902, issued to Barrett on June 26, 1973, discloses the use of butanols as carriers for a nonionic surfactant in an anhydrous mixture. U.S. Pat. No. 3,746,649, issued to Barrett on July 17, 1973, discloses the use of butanols as vehicles for an enzyme composition. U.S. Pat. No. 3,776,851, issued to Cheng on Dec. 4, 1973, teaches the use of tetrahydroxysuccinic acid—a quadrifunctional secondary alcohol—as a builder in a laundry detergent. U.S. Pat. No. 3,813,343, issued to Mukai on May 28, 1974, teaches heavy duty cleaning compositions containing specified primary and secondary alcohols. U.S. Pat. No. 3,855,142, issued to Pader et al. on Dec. 17, 1974, teaches an enzyme containing denture soaking composition which utilizes an isopropanol vehicle.

It will be apparent from the cited references that it is not new to use alcohols per se in a surfactant based cleaning composition, and it is not new to use tertiary butanol in a cleaning composition which is surfactant based. However, it is apparent that the utility of tertiary alcohols with more than 4 carbon atoms in their molecular structure as an adjunct to surfactant-based cleaning compositions has never been appreciated by the art.

DISCLOSURE OF THE INVENTION

The present invention is most broadly defined as an improved detergent composition comprising 0.05% to 50% of a surfactant and 0.5% to 50% of a tertiary alcohol having at least 5 carbon atoms per molecule. The surfactants which may be used are unlimited in type, and include those anionic, cationic, nonionic, zwitterionic and amphoteric surfactants which are known to be useful in cleaning compositions to be used on hard surfaces.

The preferred tertiary alcohols for use herein may fall within any of the defined categories which follow:

(A) heterosubstituted or unsubstituted monohydric alcohols having the following molecular structure:

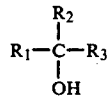

wherein $R_1$, $R_2$ and $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl and aldehyde moieties, and combinations thereof;

(B) unsubstituted alcohols having the following molecular structure:

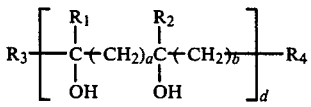

wherein $R_1$, $R_2$ and $R_3$ are as defined above; $R_4$ is selected from the same group as $R_1$, a is from 0 to about 8, b is from 0 to about 8, d is from 1 to about 4, and the values of a and b are separately selected for each repetition of d, if d is greater than 1;

(C) heterosubstituted or unsubstituted alicyclic alcohols having the following molecular structure:

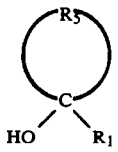

wherein $R_1$ is as defined above and $R_5$ is a substituted or unsubstituted cyclic chain of 2 to 20 carbon atoms;

(D) hetero unsubstituted alicyclic alcohols having the following structure:

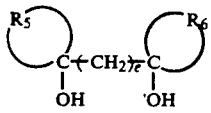

wherein $R_5$ is as defined above, $R_6$ is selected from the same groups as $R_5$, and e is 1 to about 8;

(E) hetero-substituted or unsubstituted alcohols having the following structure:

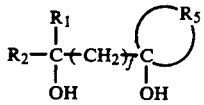

wherein $R_1$, $R_2$ and $R_5$ are as defined above and f is 0 to about 8;

(F) heterosubstituted or unsubstituted alcohols having the following structure:

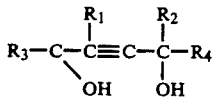

wherein $R_1$, $R_2$, $R_3$ and $R_4$ are as defined above; and (G) heterosubstituted or unsubstituted alcohols having the following structure:

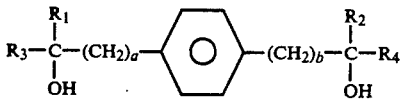

wherein $R_1$, $R_2$, $R_3$, $R_4$, a, and b are as defined above.

Also disclosed and claimed herein are surfactant-based compositions containing tertiary alcohols which exhibit one or more of the following properties: a low and unobjectionable odor when used in detergent compositions; a solid form (meaning that the melting point exceeds about 35° Celsius), which is especially useful when a solid cleaning composition is desired; and stability with respect to oxidation, which is particularly useful in cleaning compositions which contain oxidizing bleaches.

Specific formulations within the invention are disclosed and claimed in which the combination of a surfactant and a tertiary alcohol is used to formulate the following types of cleaning compositions: powdered abrasive cleansers; powdered water-dispersible cleansers; aqueous liquid cleaners; liquid abrasive cleansers; and dishwashing liquids. These compositions include the major categories of cleaning compositions which are adapted for the cleaning of solid substrates such as dishes, counters, walls, floors, bathroom fixtures, and so forth.

DEFINITIONS

A tertiary alcohol as used herein refers to an organic compound, having at least one hydroxy group attached to a carbon atom thereof, in which the alpha carbon atom with respect to each hydroxy group in the molecule is connected to 3 carbon atoms. This is the generally accepted chemical definition of a tertiary alcohol.

DETAILED DESCRIPTION OF THE INVENTION

The following detailed description of the present invention is provided in order to provide specific embodiments and a general description of the range and selection of compositions which have been found useful herein. This description, and particularly the description of preferred embodiments, is not intended to limit the invention. The scope and content of the claimed invention is specifically set forth in the claims which conclude this specification.

Most broadly stated, the present invention is an improved detergent composition comprising 0.05% to 50% of a surfactant and 0.5% to 50% of a tertiary alcohol which has at least 5 carbon atoms in its molecular structure. What follows is a description of the surfactants which are useful herein, followed by a description of the tertiary alcohols which have been found to be especially useful herein. Thereafter a description of the cleaning compositions which may be formulated is provided. The detailed description concludes with a series of examples which provide specific operative compositions which have been found to demonstrate improved cleaning.

SURFACTANT

The surfactants which are useful herein include any of the surface active agents known to the art to be useful in surfactant based cleaning compositions. Such detergents fall most broadly into the following classes: anionic, cationic, nonionic, zwitterionic and amphoteric surfactants. What follows is a broad description of each of these types of surfactants.

A. Anionic Soap and Non-Soap Synthetic Surfactants

This class of surfactants includes ordinary alkali metal soaps such as the sodium, potassium, ammonium and alkanolammonium salts of higher fatty acids containing from about 8 to about 24 carbon atoms and preferably from about 10 to about 20 carbon atoms. Suitable fatty acids can be obtained from natural sources such as, for instance, plant or animal esters (e.g., palm oil, coconut oil, babassu oil, soybean oil, castor oil, tallow, whale and fish oils, grease, lard, and mixtures thereof). The fatty acids also can be synthetically prepared (e.g., by the oxidation of petroleum, or by the Fischer-Tropsch process). Resin acids are suitable such as rosin and those resin acids in tall oil. Naphthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium or potassium tallow and coconut soap.

This class of anionic surfactants also includes water-soluble salts, particularly the alkali metal salts, of organic sulfuric reaction products having in their molecular structure an alkyl group containing from about 8 to about 22 carbon atoms and a sulfonic acid or sulfuric acid ester radical. (Included in the term alkyl is the alkyl portion of higher acyl groups.) Examples of this group of synthetic detergents which form a part of the built detergent compositions of the present invention are the water-soluble (i.e., sodium, potassium, magnesium or ammonium) alkyl sulfates, especially those obtained by sulfating the higher alcohols ($C_8$–$C_{18}$ carbon atoms) produced by reducing the glycerides of tallow or coconut oil; sodium or potassium alkyl benzene sulfates, in which the alkyl group contains from about 8 to 18 carbon atoms in straight chain or branched chain configuration, e.g., those of the type described in U.S. Pat. Nos. 2,220,099 and 2,477,383 (especially valuable are linear straight chain alkyl benzene sulfonates in which the average of the alkyl groups is about 11–12 carbon atoms, commonly abbreviated as LAS); sodium alkyl glyceryl ether sulfonates, especially those ethers of higher alcohols derived from tallow and coconut oil; sodium coconut oil fatty acid monoglyceride sulfonates and sulfates.

Another group of bleach stable surfactants are the alkali metal paraffin sulfonates containing from about 8 to 22 carbon atoms in the paraffin chain. These are well-known commercially available surfactants which can be prepared, for example, by the reaction of olefins with sodium bisulfite. Examples are sodium-1-decane sulfonate, sodium-2-tridecane sulfonate and potassium-2-octadecane sulfonate. A related group of surfactants are those having the following formula:

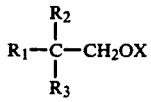

wherein $R_1$, $R_2$ and $R_3$, which can be the same or different, are alkyl groups of 1 to 18 carbon atoms, the sum of the carbon atoms of $R_1$, $R_2$ and $R_3$ being 10 to 20, and X is $-SO_3M$, $-CH_2COOM$, $-CH_2CH_2COOM$, $-(CH_2CH_2O)_nSO_3M$ or $-(CH_2CH_2O)_nCOOM$, wherein n is from 1 to 40 and M is an alkali metal (e.g., sodium or potassium). Such compounds are more fully described in U.S. Pat. No. 3,929,661, Nakagawe et al., issued Dec. 30, 1975, and incorporated herein by reference.

Other synthetic anionic surfactants useful herein are alkyl ether sulfates. These materials have the formula $[RO(C_2H_4O)_xSO_3]_yM$ wherein R is alkyl or alkenyl of about 8 to about 22 carbon atoms, x is 1 to 30, and M is a water-soluble cation, as defined hereinbefore, having a valency of y. The alkyl ether sulfates useful in the present invention are condensation products of ethylene oxide and monohydric alcohols having about 10 to about 20 carbon atoms. Preferably, R has 12 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30, and especially 3 to 6, molar proportions of ethylene oxide and the resulting mixture of molecular species, having, for example, an average of 3 to 6 moles of ethylene oxide per mole of alcohol, is sulfated and neutralized.

Specific examples of alkyl ether sulfates of the present invention are sodium coconut alkyl ethylene glycol ether sulfate; lithium tallow alkyl triethylene glycol ether sulfate; sodium tallow alkyl hexaoxyethylene sulfate; and sodium tallow alkyl trioxyethylene sulfate. The alkyl ether sulfates are known compounds and are described in U.S. Pat. No. 3,332,876 to Walker (July 25, 1976), incorporated herein by reference.

Still other synthetic anionic surfactants are the alkali metal salts of alkyl phenol ethylene oxide ether sulfate with about four units of ethylene oxide per molecule and in which the alkyl radicals contain about 9 carbon atoms; the reaction product of fatty acids esterified with isethionic acid and neutralized with sodium hydroxide where, for example, the fatty acids are derived from coconut oil; sodium or potassium salts of fatty acid amides of a methyl taurine in which the fatty acids, for example, are derived from coconut oil; and others known in the art.

Generally, then, a wide variety of preferred anionic surfactants are useful in the instant compositions as providing the necessary detergency for hard surface cleaning. Most preferred anionic surfactants include $C_8$ to $C_{16}$ alkyl benzene sulfonates, $C_{12}$ to $C_{18}$ alkyl sulfates, $C_{12}$ to $C_{18}$ ethoxylated alkyl sulfates having from 1 to 10 ethoxy moieties, and sodium paraffin sulfonates wherein the alkyl portion contains from 8 to 16 carbon atoms. For reasons of cleaning efficacy, economics and environmental compatibility, sodium linear alkyl benzene sulfonates having from 11 to 12 carbon atoms ($C_{11.8}$ avg.) in the alkyl portion are most particularly preferred.

B. Nonionic Synthetic Surfactants

Nonionic surface active agents operable in the instant compositions can be any of three basic types—the alkylene oxide condensates, the amides and the semi-polar nonionics.

The alkylene oxide condensates are broadly defined as compounds produced by the condensation of alkylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Examples of such alkylene oxide condensates include:

1. The condensation products of aliphatic alcohols with ethylene oxide. The alkyl chain of the aliphatic alcohol can either be straight or branched and generally contains from about 8 to about 22 carbon atoms. The chain of ethylene oxide can contain from 2 to 30 ethylene oxide moieties per molecule of surfactant. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-7 marketed by the Shell Chemical Company and Kyro EOB marketed by the Procter & Gamble Company.

2. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-610 marketed by the GAF Corporation; and Triton X-45, X-100 and X-102, all marketed by the Rohm and Haas Company.

3. The condensation products of ethylene oxide with a hydrophobic base formed by the condensation of propylene oxide with propylene glycol. The hydrophobic portion of these compounds has a molecular weight of from about 1,500 to 1,800 and of course exhibits poor water solubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product. Examples of compounds of this type include certain of the commercially available Pluronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2,500 to about 3,000. This base is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

The amide type of nonionic surface active agents includes the ammonia, monoethanol and diethanol amides of fatty acids having an acyl moiety of from about 7 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by the Fischer-Tropsch process.

The amide surfactants useful herein may be selected from those aliphatic amides of the general formula:

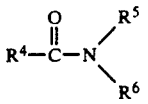

wherein $R^4$ is hydrogen, alkyl, or alkylol and $R^5$ and $R^6$ are each hydrogen, $C_2$–$C_4$ alkyl, $C_2$–$C_4$ alkylol, or $C_2$–$C_4$ alkylenes joined through an oxygen atom, the total number of carbon atoms in $R^4$, $R^5$ and $R^6$ being from about 9 to about 25. A further description and detailed examples of these amide nonionic surfactants are contained in U.S. Pat. No. 4,070,309, issued to Jacobsen on Jan. 24, 1978. That patent is hereby incorporated herein by reference.

The semi-polar type of nonionic surface active agents include the amine oxides, phosphine oxides and sulfoxides.

The amine oxides are tertiary amine oxides corresponding to the general formula:

$$R^1—OR^2—_nN(R^3)_2\rightarrow O$$

in which $R^1$ is an alkyl radical of from about 8 to about 18 carbon atoms; $R^2$ is an alkylene or a hydroxy alkylene group containing 2 to 3 carbon atoms; n ranges from 0 to about 20; and each $R^3$ is selected from the group selected from alkyl or hydroxyalkyl of 1–3 carbon atoms and mixtures thereof. The arrow in the formula is a conventional representation of a semi-polar bond. The preferred amine oxide detergents are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, hetadecyldimethylamine oxide, octadecyldimethylamine oxide, dodecyldipropylamine oxide, tetradecylpropylamine oxide, hexadecyldipropylamine oxide, tetradecyldibutylamine oxide, octadecyldibutylamine oxide,bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Suitable semi-polar nonionic detergents also include the water-soluble phosphine oxides having one alkyl or hydroxyalkyl moiety of 8 to 28 carbon atoms, preferably 8 to 16 carbon atoms and 2 alkyl moieties selected from the group consisting of alkyl groups and hydroxyalkyl groups containing 1 to 3 carbon atoms. Examples of suitable phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

The semi-polar nonionic detergents useful herein also include the water-soluble sulfoxide detergents, which contain one alkyl or hydroxyalkyl moiety of 8 to 18 carbon atoms, preferably 12 to 16 carbon atoms and one alkyl moiety selected from the group consisting of alkyl and hydroxyalkyl groups having 1 to 3 carbon atoms. Specific examples of the sulfoxides include dodecylmethyl sulfoxide, 2-hydroxyethyltridecyl sulfoxide, hexadecylmethyl sulfoxide, 3-hydroxyoctadecylethyl sulfoxide.

C. Amphoteric Synthetic Surfactants

Ampholytic and amphoteric detergents are also useful herein. Ampholytic synthetic detergents can be broadly described as derivatives of aliphatic amines which contain a long chain of about 8 to 18 carbon atoms and an anionic water-solubilizing group, e.g., carboxy, sulfo or sulfato. Examples of compounds falling within this definition are sodium 3-dodecylaminopropionate, sodium-3-dodecylamino propane sulfonate, and dodecyl dimethylammonium hexanoate. Other examples of ampholytic and amphoteric surfactants are found in U.S. Pat. No. 3,318,817, issued to Cunningham on May 9, 1967, and hereby incorporated herein by reference.

D. Zwitterionic Synthetic Surfactants

Zwitterionic surface active agents operable in the instant composition are broadly described as internally-neutralized derivatives of aliphatic quaternary ammonium, phosphonium and tertiary sulfonium compounds, in which the aliphatic radical can be straight chain or branched, and wherein one of the aliphatic substituents contains from about 8 to 18 carbon atoms and one contains an anionic water-solubilizing group, e.g., carboxy, sulfo, sulfato, phosphato, or phosphono. Some of these zwitterionic surfactants are described in the following U.S. Pat. Nos.: 2,129,264; 2,178,353; 2,774,786; 2,813,898; and 2,828,332. The ammonio-propane sulfonates containing about 8 to about 21 carbon atoms are one class of surfactant compounds preferred herein by virtue of their relatively low calcium ion (hardness) sensitivity.

The specific preferred examples of zwitterionic surfactants are those having the formula:

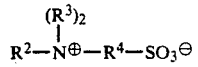

$$R^2-\overset{(R^3)_2}{\overset{|}{N}}{}^{\oplus}-R^4-SO_3^{\ominus}$$

wherein $R^2$ contains from about 8 to about 16 carbon atoms and has an average of from about 10 to about 13 carbon atoms, each $R^3$ is selected from the group consisting of alkyl and hydroxy alkyl groups containing from 1 to about 3 carbon atoms, and $R^4$ is a saturated alkylene or hydroxy alkylene group containing from 2 to about 5 carbon atoms and wherein the hydroxy group in said hydroxyalkylene group is attached to a carbon atom which is separated from the nitrogen atom by at least one methylene group.

The water-soluble betaine surfactants are another example of a zwitterionic surfactant useful herein. These materials have the general formula:

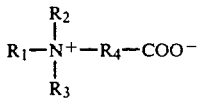

$$R_1-\overset{\overset{R_2}{|}}{\underset{\underset{R_3}{|}}{N}}{}^{+}-R_4-COO^-$$

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and are hence not preferred for optional inclusion in the instant compositions.)

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldimethylammonium pentanoate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

E. Cationic Synthetic Surfactants

Suitable cationic detergents are those having the formula $R\text{-}N(R^2)_3{}^{(+)}X^{(-)}$ wherein R is an alkyl chain containing from about 8 to about 20 carbon atoms, and each $R^2$ is selected from the group consisting of alkyl and alkanol groups containing from 1 to 4 carbon atoms and benzyl groups there being normally no more than one benzyl group. Two $R^2$ groups can be joined by either a carbon-carbon ether, or imino linkage to form a ring structure. X represents a halogen atom, sulfate group, nitrate group or other pseudohalogen group. Specific examples are coconut alkyl trimethyl amine chloride, dodecyl dimethyl benzyl bromide, and dodecyl methyl morpholino chloride.

F. Fluorocarbon Surfactants

Although the preceding description of surfactants discloses the broad categories of surfactants which are in general use in the hard surface cleaning art, it will be appreciated that other surfactants are known. Such other surfactants are useful in formulation of hard surface cleaners within the present invention. One class of such surfactants which are useful in practicing the present invention is that of fluorocarbon surfactants.

The fluorocarbon surfactants are analogs of conventional surfactants wherein part or all of the hydrogen atoms of the carbon skeleton are replaced with fluorine atoms. Such surfactants can fall within any of the traditional classes of surfactants including but not limited to anionic and nonionic surfactants. Specific examples of fluorocarbon surfactants useful herein are perfluorooctanoic acid, available from The Eastman Kodak Company, and a surfactant having the following formula:

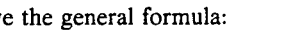

$$CF_3(CF_2)_7SO_2N(C_2H_5)CH_2COO^{\ominus}K^{\oplus}$$

The latter surfactant is sold as FC-128 by Minnesota Mining and Manufacturing Company.

Tertiary Alcohols

The tertiary alcohols useful herein are most broadly defined as those tertiary alcohols which have 5 to 100 carbon atoms in their molecular structure.

Preferred tertiary alcohols for use herein are those which fall into one of the following categories:

(A) heterosubstituted or unsubstituted monohydric alcohols having the following molecular structure:

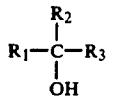

wherein $R_1$, $R_2$ and $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl and aldehyde moieties, and combinations thereof;

(B) unsubstituted alcohols having the following molecular structure:

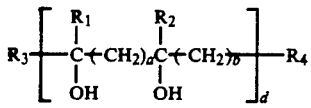

wherein $R_1$, $R_2$ and $R_3$ are as defined above; $R_4$ is selected from the same group as $R_1$, a is from 0 to about 8, b is from 0 to about 8, d is from 1 to about 4, and the values of a and b are separately selected for each repetition of d, if d is greater than 1;

(C) heterosubstituted or unsubstituted alicyclic alcohols having the following molecular structure:

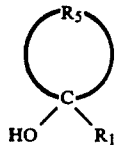

wherein $R_1$ is as defined above and $R_5$ is a substituted or unsubstituted cyclic chain of 2 to 20 carbon atoms;

(D) hetero unsubstituted alicyclic alcohols having the following structure:

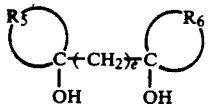

wherein $R_5$ is as defined above, $R_6$ is selected from the same group as $R_5$, and e is 1 to about 8;

(E) hetero-substituted or unsubstituted alcohols having the following structure:

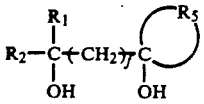

wherein $R_1$, $R_2$ and $R_5$ are as defined above and f is 0 to about 8;

(F) heterosubstituted or unsubstituted alcohols having the following structure:

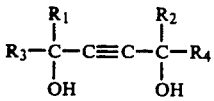

wherein $R_1$, $R_2$, $R_3$ and $R_4$ are as defined above; and (G) heterosubstituted or unsubstituted alcohols having the following structure:

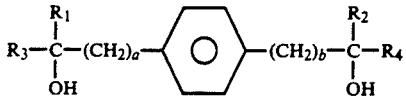

wherein $R_1$, $R_2$, $R_3$, $R_4$, a, and b are as defined above.

Of the above tertiary alcohols, those in A-E above are stable with respect to oxidizing bleaches if $R_1$, $R_2$, $R_3$ and $R_4$ are limited to alkyl groups and if $R_5$ and $R_6$ are limited to cycloalkyl groups.

The following species are specific examples of tertiary alcohols within the present invention:

(1) tertiary amyl alcohol
(2) 3-methyl-3-hexanol
(3) 3-methyl-3-heptanol
(4) 3,5-dimethyl-3-heptanol
(5) 2-methyl-2-dodecanol
(6) 2-methyl-2-octadecanol
(7) 3-methyl-6-decene-3-ol
(8) 2-methyl-2-hydroxypentanoic acid
(9) Sodium-3-methyl-3-hydroxypentanoate
(10) 2-methyl-2-pentanol
(11) 2-methyl-2-hydroxypropionitrile
(12) 2-phenyl-2-propanol
(13) 2,5-dimethyl-2,5-hexanediol
(14) 1,2-di(1-cyclochexanol)ethane
(15) 2,6-dihydroxy-2,6-dimethylheptanoic acid
(16) 2,5-diethyl-3-hexyne-2,5-diol
(17) 1-(3-pentane-3-ol)-4-(2-hydroxy-2-methylpropyl)-benzene
(18) 4-isopropyl-1-methylcyclohexanol
(19) 3-ethyl-3-pentanol
(20) 2,4,7,9-tetrahydroxy-2,4,7,9-tetramethyldecane
(21) 2-methyl-2-hydroxypropanoic acid, methyl ester
(22) 2-p-tolyl-2-propanol
(23) 4,4-dicyclohexyl-1-butene-4-ol
(24) 1-methyl-1-cyclohexanol
(25) 4-hydroxy-4-methyl-2-pentyne
(26) methyl(2-methyl-2-hydroxybutyl)ether
(27) 1,1-diphenyl,1-hydroxy-2-methyl butane
(28) 2,7-dimethyl-2,7-nonanediol
(29) 2,3-dimethyl-2,3-pentanediol
(30) 3-methyl-6-ethyl-3,6-nonanediol
(31) 4(1-cyclohexanol)-2-methyl-2-butanol
(32) 2,7-dimethyl-2,7-octanediol
(33) 2-(4-methylcyclohexyl)-2-propanol Of the above examples, the tertiary alcohols numbered 1, 2, 3, 4, 5, 6, 10, 13, 14, 18, 19, 20, 24, 28, 30, 31, 32 and 33 are examples of those preferred for use in compositions containing oxidizing materials, in particular, bleaches of the types which release active oxygen or chlorine in use. This is discussed further in connection with the description of compositions which contain oxidizing bleaches.

Of the listed tertiary alcohols, several of those species which are solid (having a melting temperature higher than about 35° C.) and water-soluble (having a solubility of at least 0.1% by weight in water) are highly preferred when a solid cleaning composition is to be formulated. These species will be easily formulated in stable form because they are solids at room temperature. They also are functional in the surfactant-based cleaning compositions of the present invention because they dissolve in water sufficiently to achieve an effective concentration. Examples of these species are numbers 13, 14, 15, 16, 17, 20, 28, 29 and 30.

Some of the liquid tertiary alcohols are useful in formulating liquid cleaning compositions, even though they are somewhat insoluble in water, for they are able to act in suspended or solubilized aqueous form. Some examples of species which share this property are numbers 1, 2, 3, 4, 7, 10, 12, 18, 19, 21, 23, 24, 25, 26 and 33.

The listed tertiary alcohols are either commercially available or easily synthesized and isolated by those skilled in organic chemistry.

What follows is a description of several types of surfactant-based cleaning compositions which may be formulated with the tertiary alcohols of the present invention in order to improve the cleaning performance of the compositions. It should be realized that the performance of the cleaning compositions disclosed hereinafter depends on the unexpected coaction of the surfactants and tertiary alcohols of the compositions.

Liquid Abrasive Cleansers

A general description of the problems, variations, and properties of liquid abrasive cleansers may be found in U.S. Pat. Nos. 3,985,668, issued to Hartman on Oct. 12, 1976, 4,005,027, issued to Hartman on Jan. 25, 1977; 4,051,055, issued to Trinh and Yeazell on Sept. 27, 1977; and 4,051,056, issued to Hartman on the same date. The foregoing patents are hereby incorporated herein by reference.

Liquid abrasive cleansers embodying the present invention are characterized in the description which follows:

The liquid abrasive cleansers of the present invention contain from 0.05% to 10% of a surfactant, and preferably contain from 0.1% to about 7% of a surfactant which is stable with respect to the amounts of hypochlorite taught to be useful herein. The specific bleach stable surfactants preferred for use in liquid abrasive cleansers are the water-soluble alkyl sulfates (described above) containing from about 8 to about 18 carbon atoms. Specific examples of alkyl sulfate salts which can be employed in the instant compositions include sodium lauryl sulfate, sodium stearyl sulfate, sodium palmityl sulfate, sodium decyl sulfate, sodium myristyl sulfate, potassium lauryl sulfate, potassium stearyl sulfate, potassium decyl sulfate, potassium palmityl sulfate, potassium myristyl sulfate, sodium dodecyl sulfate, potassium dodecyl sulfate, potassium tallow alkyl sulfate, sodium tallow alkyl sulfate, sodium coconut alkyl sulfate, potassium tallow alkyl sulfate, potassium coconut alkyl sulfate and mixtures of these surfactants. Highly preferred alkyl sulfates are sodium coconut alkyl sulfate, potassium coconut alkyl sulfate, potassium lauryl sulfate and sodium lauryl sulfate.

Other bleach-stable surfactants preferred herein are the paraffin sulfonate surfactants and related surfactants described previously.

The liquid abrasive cleansing compositions of the present invention contain from 0.5% to 40% of a tertiary alcohol having at least 5 carbon atoms, which is further characterized by stability with respect to hypochlorite and other oxidizing bleaches. Specific examples of bleach-stable tertiary alcohols are those described as such in the above broad description and examples of tertiary alcohols within the present invention. A highly preferred bleach-stable tertiary alcohol for use herein is 1-methyl-1-cyclohexanol.

The liquid abrasive cleansers described herein desirably contain from about 1% to about 65% of an abrasive material. The abrasives which can be used include any of the substantially water-insoluble particulate materials conventionally used in abrasive cleansers. Such insoluble materials should have particle size diameters ranging from about 1 to about 250 microns (preferably from 10 to 110 microns) and a specific gravity (as determined by water displacement) of about 0.2 to 2.2, preferably from about 0.5 to about 0.99. Examples of such abrasives include (but are not limited to) quartz, pumice, pumicite, titanium dioxide, silica sand, calcium carbonate, calcium phosphate, calcium pyrophosphate, zirconium silicate, diatomaceous earth, whiting, perlite, tripoli, melamine, urea formaldehyde and expanded perlite. Mixtures of the above types of abrasive materials can also be employed. Silica sand, calcium carbonate and expanded perlite are the preferred abrasives for use in the instant compositions. Expanded perlite is especially preferred because its low density, lower than the specific gravity of water, prevents it from settling. Preferably, the abrasive level for the compositions herein is from about 2% to 25% by weight and more preferably from about 3% to 15% by weight.

The liquid abrasive cleansers described herein contain from about 10% to 95% water, preferably from about 50% to 90% water. In the present compositions water serves as a diluent and as a medium for carrying the hypochlorite and other functional components of the composition. Since it is well known that some transition metal ions, which can react with and deactivate oxidizing bleaches, are often present in untreated water, the term "water" for purposes of the formulation of liquid abrasive cleansers containing bleach means soft or deionized water.

The liquid abrasive cleansers can contain 1% to 30% of a mineral clay having a cation exchange capacity of at least 3, and preferably at least 40, milliequivalents of cation per 100 grams of clay. Preferred clays are kaolinite, hydrated halloysite, smectite, illite, vermiculite, chlorite, seprolite, attapulgite and polygorskite clays. Most preferred are smectite clays, which have cationic exchange capacities of about 80 to 150 milliequivalents per 100 grams. Mixtures containing the indicated amount of the recited clays become "false-bodied" non-Newtonian fluids when subjected to high shear mixing during their manufacture. As a result, the present compositions have a high viscosity (and thus high suspension stability) at rest, yet when a force is exerted on the composition, as by squeezing a squeeze bottle containing it, it becomes less viscous and is easily squirted out of its container.

Although the compositions herein can consist simply of the surfactant, tertiary alcohol, abrasive and water, it is generally preferred that the compositions contain additional materials such as bleaches, sources of water-soluble fluoride ions, inorganic alkaline salts, sequestering agents, and the like. The type and amount of these additional materials which are incorporated into the compositions will be dependent upon the particular cleaning task to which the product is directed.

The liquid abrasive cleansers can contain from 0% to about 50%, preferably from 0.1% to about 10%, and more preferably from about 0.1% to about 5% of an oxidizing bleach. A first variety of oxidizing bleach which is useful herein is one which produces hypochlorite ions in aqueous solution. The hypochlorite ion is a strong oxidizing agent and for this reason materials which yield this species are considered to be powerful bleaching agents. Examples of such types of materials include the following: Alkali metal and alkaline earth metal hypochlorites, hypochlorite addition products, chloramines, chlorimines, chloramides and chlorimides. Specific examples of compounds falling within these general types include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate, sodium dichloroisocyanurate dihydrate, 1,3-dichloro-5,5-dimethylhydantoin, N-chlorosulfamide, chloramine-T, dichloroamine-T, chloramine-D and dichloramine-B. The preferred hypochlorite bleaching agent is sodium hypochlorite.

Liquid abrasive cleansers of the present invention may contain 0% to 30%, preferably 0.15% to 30%, of a soluble fluoride salt. Examples of such salts are the alkali metal, zinc, stannous and indium fluorides, as well as complex fluorides such as the metal difluorophosphates. Such fluoride salts, in combination with the described clays, have been found to improve cleaning performance. This is more fully explained in U.S. Pat. No. 4,051,055, incorporated by reference above.

The inorganic salts and sequestering agents which are useful herein are characterized more fully in U.S. Pat. No. 4,051,055, incorporated by reference above.

Powdered Abrasive Cleansers

Powdered abrasive cleansers have long been known to be useful for scouring porcelain sinks and fixtures, hard metallic materials, pots and pans, and similar surfaces which require high levels of mechanical abrasive for cleaning. The formulation of such powdered abrasive cleansers is discussed in great detail in U.S. Pat. Nos. 3,583,922, issued to McClain et al. on June 8, 1971; 3,829,385, issued to Abbott, Jr., et al. on Aug. 13, 1974; and 3,715,314, issued to Morganstern on Feb. 6, 1973. The foregoing patents are hereby incorporated herein by reference.

The improved powdered abrasive cleansers described herein contain from about 0.1% to 6% of a suitable surfactant. The water-soluble organic detergents which can be used in the detergent compositions of this invention are the anionic, nonionic, zwitterionic and cationic organic detergents.

Examples of suitable detergents for use in the compositions of this invention include those cationic, anionic, nonionic and zwitterionic detergents described above.

Particularly preferred detergent compounds for use in the present powdered abrasive cleansers are the non-soap anionic detergents, particularly the alkyl benzene sulfonate detergents wherein the alkyl group has from 8 to 18 carbon atoms. Suitable examples are sodium decyl benzene sulfonate, sodium dodecyl and pentadecyl sulfonates wherein the dodecyl and pentadecyl groups are derived from a propylene polymer, and sodium octadecyl benzene sulfonates. Other preferred anionic detergents are the surface active sulfated or sulfonated aliphatic compounds, preferably having 8 to 22 carbon atoms. Examples thereof are the long chain pure or mixed higher alkyl sulfates, e.g., lauryl sulfates and coconut fatty alcohol sulfates. The anionic detergent components are commonly used in the form of their water-soluble salts. Preferred water-soluble cations are the alkali metal and ammonium cations, the sodium and potassium cations being particularly preferred.

A second essential component of the powdered abrasive cleansers described herein is a tertiary alcohol having at least 5 carbon atoms. Since in a highly preferred embodiment of the present invention the cleanser composition contains an oxidizing bleach, as described below, it is highly preferred to use those tertiary alcohols, as described above, which are stable with respect to hypochlorite. A highly preferred tertiary alcohol for use in powdered abrasive cleansers is 2,5-dimethyl-2,5-hexanediol. The tertiary alcohol comprises 0.5% to 40% of the powdered abrasive cleanser composition.

The powdered abrasive cleansers of the present invention contain from about 20% to 95%, preferably from about 60% to about 90% of a water-insoluble abrasive material. In addition to the abrasive materials noted above in the description of liquid abrasive cleansers, feldspar may also be used as an abrasive material in powdered abrasive cleansers. The preferred abrasive materials for use herein are silica and feldspar. The abrasive particles should have a diameter of from about 0.3 millimeters to about 0.001 millimeters or finer.

Although the oxidizing materials described in connection with liquid abrasive cleansers are suitable for use in similar amounts herein, other oxidizing bleaches for use in the solid abrasive cleansers are the N-haloamide bleaching and oxidizing agents which are heterocyclic imides characterized by the following structure:

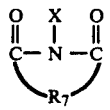

where $R_7$ is $C_1$ to $C_3$ alkyl, X is halogen such as chlorine or bromine, and in which the electron donating nitrogen atom is doubly activated to an acidic state by virtue of its proximity to two electropositive carbonyl groups. Suitable N-halo-amide compounds are the N-chloro-derivatives of cyanuric acid such as mono-, di- and trichlorocyanuric acid. Other examples include the N-chlorosuccinimides, N-chloromalonimides, N-chlorophthalimides and N-chloronaphthalimides. Other examples are described in U.S. Pat. No. 3,406,116, issued to Vitale on Oct. 15, 1968, and in U.S. Pat. No. 3,257,324 issued to Wearn et al. on June 21, 1966. These patents are hereby incorporated herein by reference. These N-chloro imides can be employed as a single bleaching source or in combination with an alkali metal bromide, for example, sodium bromide, in order to provide an oxidizing hypobromite species.

Suitable N-bromo-imides include a hypobromite liberating compound such as tribromocyanuric acid, dibromocyanuric acid, potassium dibromocyanurate, N-bromosuccinimide, N-bromomalonimide, and 1-3-dibromo-5,5-dimethylhydantoin. N-halo-imides which yield both hypochlorite and hypobromite in solution, such as N-dibromo-N-monochlorocyanuric acid and potassium N-monobromo-N-monochlorocyanurate can also be employed. Examples of these compounds are described in U.S. Pat. No. 3,575,865, issued to Burke et al. Of the above N-haloimide compounds, several are capable of salt formation and of those the alkali and alkaline earth metal salts thereof are useful herein. Particularly preferred alkali metal salts useful herein are the alkali metal, for example, potassium and sodium dichloroisocyanurates.

The powdered abrasive cleansers of the present invention can contain a variety of ingredients in addition to those mentioned hereinbefore. Thus, alkaline detergency builders can be employed for enhanced cleaning effects. These detergency builders enhance the detergency effect of the organic detergent component and aid in the regulation of the desired pH of the detergent composition. Suitable alkaline detergency builders include, for example, sodium sesquicarbonate, trisodium phosphate, tetrasodium pyrophosphate, sodium acid pyrophosphate, sodium tripolyphosphate, sodium monobasic phosphate, sodium dibasic phosphate, sodium hexametaphosphate, sodium citrate, sodium silicates having a silicon dioxide to disodium oxide ratio of 1:1 to 3.2:1, sodium carbonate, borax, trisodium nitrilotriacetate and the like. Mixtures of two or more inorganic or organic salts can be employed, as can mixtures of inorganic and organic salts. Other examples of suitable alkaline detergency builders include those described in U.S. Pat. No. 3,309,319, at Col. 4, line 44 through Col. 5, line 9. The disclosure of this patent is hereby incorporated herein by reference.

Other ingredients which can also be present in the powdered abrasive cleansers of the present invention include inorganic salts such as sodium chloride, sodium sulfate, potassium chloride, and potassium sulfate, these being included in the composition in amounts less than about 20% by weight of the composition. Sodium acetate may be added to the composition as a stabilizing compound at a level of 2–10 times the amount of free or loosely bound moisture which is encountered in the compound during processing or as a result of humidity. Other minor ingredients which can be included are anticaking agents such as hydrated magnesium trisilicate or sodium carboxymethyl cellulose, sulfamic acid, perfume, antiseptics, germicides, aluminium mark removing agents such as calcium oxide or hydroxide, coloring agents, and the like.

Powdered Water-Dispersible Cleanser

Powdered water-dispersible cleansers are used in order to clean any of a wide variety of surfaces, particularly those which are sensitive to abrasion so that an abrasive cleanser may not be used. To use such a composition it is diluted in water to form a cleaning solution which is then applied to the hard surface to be cleaned. A prior art example of such a powdered water-dispersible cleaner is SPIC AND SPAN, distributed by The Procter & Gamble Company. What follows is a description of the powdered water-dispersible cleansers which are formulated in accordance with the present invention. Other ingredients of such compositions may be found in U.S. Pat. No. 3,970,594, issued to Claybaugh on July 20, 1976. This patent is hereby incorporated by reference herein.

The water-dispersible powdered cleansers of the present invention contain from 0.9% to 20% of a surfactant, preferably from about 0.9% to 5% of a surfactant. The organic surfactants useful herein are any of the anionic, nonionic, ampholytic, and zwitterionic surfactants enumerated in the general surfactant description above. These surfactants are included at levels which inhibit undesirable foaming and surface streaking, yet which provide advantageous removal of soils, particularly soils of lipophilic and particulate character.

Of all the above-described surfactants, anionic surfactants are the most preferred. Especially preferred anionic surfactants are sodium linear $C_{11-12}$ alkyl benzene sulfonate (LAS), ethoxylated tall oil and mixtures thereof. In the event that the two preferred surfactants are mixed, the LAS comprises from about 0.05% to 3% by weight of the composition and the ethoxylated tall oil comprises from about 0.05% to about 0.5% by weight of the composition.

The water-dispersible powdered cleansers of the present invention further comprise from 0.5% to 20% of a tertiary alcohol of the type described. Since the compositions are formulated as powdered solids, it is usually desirable that the tertiary alcohol be a solid at room temperature (and at the ordinary storage temperatures of the composition) in order to provide the tertiary alcohol in a substantial quantity while allowing the composition to remain a freely flowing powder. The tertiary alcohols preferred herein are those identified as having melting points greater than about 35° Celsius in the above description of tertiary alcohols. A highly preferred tertiary alcohol for use herein is 2,5-dimethyl-2, 5-hexanediol.

Builder salts are essential to the powdered water-dispersible cleansers described herein and comprise from about 0.5% to about 99% by weight of the composition, preferably from 25% to about 99% by weight of the granular compositions. The suitable builders are water-soluble or water-dispersible in nature and comprise organic and inorganic salts. Mixtures of organic and inorganic salts can be employed.

Suitable inorganic alkaline builder salts which can be used in this invention alone or in admixture include alkali metal carbonates, borates, phosphates, polyphosphates, bicarbonates, and silicates. Ammonium or substituted ammonium, e.g., triethanol ammonium, salts of these materials, can also be used. Specific examples of suitable salts are sodium tripolyphosphate, trisodium phosphate, sodium sesquicarbonate, sodium carbonate, sodium tetraborate, sodium and potassium pyrophosphate, sodium and ammonium bicarbonate, potassium tripolyphosphate, sodium hexaphosphate, sodium orthophosphate, and potassium bicarbonate. The preferred alkaline builders according to this invention are the alkali metal phosphates, carbonates, silicates, polyphosphates and sesquicarbonates. Most preferred are sodium tripolyphosphate, trisodium phosphate, sodium sesquicarbonate, and mixtures thereof.

Suitable organic alkaline builder salts used in this invention (alone or in admixture) are alkali metal, ammonium or substituted ammonium aminocarboxylates: for example, sodium and potassium ethylene diamine tetraacetate, sodium and potassium N-(2-hydroxyethyl)-ethylene and diamine triacetates, sodium and potassium nitrilotriacetates and sodium, potassium and triethyl ammonium N-(2-hydroxyethyl)-nitrilodiacetates. The alkali metal, ammonium and alkanol ammonium salts of citric acid can be suitably employed. The alkali metal salts of phytic acid, for example, the sodium salts thereof, are also suitable as organic alkali sequestant builder salts.

Polyphosphonates are also valuable builders in terms of the present invention, including specifically sodium and potassium salts of ethane-1-hydroxy-1,1-diphosphonic acid, sodium and potassium salts of methylene diphosphonic acid, and sodium and potassium salts of ethane-1,1,2-triphosphonic acid. Other examples include the alkali metal salts of ethane-2-carboxy-1,1-diphosphonic acid, hydroxy methane diphosphonic acid, carbonyl diphosphonic acid, ethane-1-hydroxy-1, 1,2-triphosphonic acid, ethane-1-hydroxy-1,1,2-triphosphonic acid, propane-1,1,3,3-tetraphosphonic acid, propane-1,1,2,3-tetraphosphonic acid, and propane-1,2,2,3-tetraphosphonic acid.

The useful builders can be formulated to provide either phosphate-containing or phosphate-free cleaning compositions, although phosphate-containing compositions are preferred from the standpoint of soil removal.

In addition to the above described essential components of powdered, water-dispersible cleansers, these compositions can optionally contain such conventional detergent composition components as moisture (free or bound), fillers such as sodium sulfate or other neutral salts, bleaches of the types defined above in connection with liquid or powdered abrasive cleansers, hydrotropes, processing aids, enzymes, germicides, perfumes and coloring agents. If present, such components generally comprise from about 0.5% up to 50% by weight of the composition, especially if high levels of fillers are employed. Preferably, the compositions herein contain no bleach or enzyme which could be potentially deleterious to the surface being cleaned.

Aqueous Liquid Cleaners

Aqueous liquid cleaners are used full strength or in further dilution in water by the consumer to clean a wide variety of hard surfaces.

The uses for such cleaning liquids are too numerous to be specified completely, but such liquids are useful for cleaning of painted surfaces, walls, floors, appliance exterior surfaces, tables, chairs, windows, mirrors, and so forth. Many of such compositions may be formulated by diluting the powdered nonabrasive cleansers described above to a concentration of roughly 0.4% to about 20% in water. Such compositions are included within the present definition of aqueous liquid cleaners. Alternatively, such aqueous liquid cleaners may be directly formulated as taught hereinafter. In the latter case, the compositions will have the following ingredients and proportions.

First, such liquid cleaners contain from 0.5% to 20% of a suitable surfactant. Successively more preferred ranges of surfactant inclusion are from 1% to 10% of a surfactant, and from 2% to 5% of a surfactant. Broadly, the surfactants useful for formulation of aqueous liquid cleaners are those in the broad surfactant disclosure above. Preferred surfactants for use in such cleaners are one or more of the following: sodium linear $C_{11-12}$ alkyl benzene sulfonate (LAS); the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol 15-S-3, Tergitol 15-S-5, Tergitol 15-S-7, and Tergitol 15-S-9, all available from Union Carbide Corporation; the sodium and potassium salts of coconut fatty acids (coconut soaps); the condensation product of a straight-chain primary alcohol containing from about 8 carbon atoms to about 16 carbon atoms and having an average carbon chain length of from about 10 to about 12 carbon atoms with from about 4 to about 8 moles of ethylene oxide per mole of alcohol; an amide having one of the preferred formulas:

$$R-\overset{\overset{\displaystyle O}{\|}}{C}-N(R^1)_2$$

wherein R is a straight-chain alkyl group containing from about 7 to about 15 carbon atoms and having an average carbon chain length of from about 9 to about 13 carbon atoms and wherein each $R^1$ is a hydroxy alkyl group containing from 1 to about 3 carbon atoms; a zwitterionic surfactant having one of the preferred formulas in the broad surfactant disclosure above; or a phosphine oxide surfactant having one of the preferred formulas in the broad disclosure of semipolar nonionic surfactants. An especially preferred surfactant for use herein is the sodium salt of linear $C_{11-12}$ alkyl benzene sulfonate (LAS).

A second essential ingredient of aqueous liquid cleaners of the present invention is 0.5% to 20% of a tertiary alcohol having at least 5 carbon atoms in its molecular structure, or mixtures of such tertiary alcohols. While any of the enumerated examples of tertiary alcohols which were cited above can be used herein, those exemplary tertiary alcohols which are numbered 10, 13, 16, 18, 19 and 25 in the above description are particularly preferred for use herein. Most preferred for use herein is 2-phenyl-2-propanol at a level of 1% to 5%, preferably about 2% of the composition.

A third required component of the aqueous liquid cleaners of the present invention is 0.5% to 80% of a builder salt. While any of the builders or inorganic salts described above in connection with powdered nonabrasive cleansers may be used herein as builders, the preferred builders for use herein are sodium nitrilotriacetate, potassium pyrophosphate, potassium tripolyphosphate, sodium or potassium ethane-1-hydroxy-1, 1-diphosphonate, sodium citrate, sodium carbonate, sodium sulfite, sodium bicarbonate, and so forth. One class of builders particularly useful herein are the fugitive builders, in particular aqueous ammonia, ordinarily described in its aqueous form as ammonium hydroxide. Most preferred builders for use herein are sodium carbonate, sodium bicarbonate, tetrapotassium pyrophosphate, sodium sulfite, and ammonium hydroxide, as well as mixtures of these preferred materials.

An optional ingredient which is sometimes highly desirable in aqueous liquid cleaners is a hydrotrope which serves to stabilize the compositions by aiding in the solubilization of their components. 0% to about 12% of the hydrotroping agent is used. The hydrotroping agent is selected from the group consisting of alkali metal, ammonium, and triethanolammonium isopropylbenzene sulfonates, xylene sulfonates, toluene sulfonates, benzene sulfonates, and mixtures thereof. Specific hydrotroping agents found to be useful herein are sodium cumene sulfonate and potassium toluene sulfonate.

Instead of using a hydrotroping agent to solubilize the ingredients to form a stable mixture, the aqueous liquid cleaners may also be provided in a form of an emulsion. In that event, the hydrotrope should be omitted and an emulsion stabilizer added in amounts of from about 0.5% to about 2%, preferably from about 0.8% to about 1.5% of the composition. Acrysol AFE-108, a commercial product, is preferred as an emulsion stabilizer.

In many applications it will be highly desirable to incorporate a suds suppressor as an optional ingredient in the aqueous liquid cleaners herein. The purpose of this ingredient is to eliminate the need to repetitively rinse a surface after it is washed in order to remove all visible traces of the surfactant. The composition should contain about 1–3% of the suds suppressor, if it is used. One example of a suitable suds suppressor is a surfactant which is the condensation product of a straight-chain random secondary alcohol having a chain length of from about 11 to about 15 carbon atoms and having an average length of from about 12 to about 15 carbon atoms with from about 0 to about 3 moles of ethylene oxide. There is a definite relationship between the amount of primary surfactant and the amount of the suds suppressor which should be used. There is from about 1% to about 3%, preferably from about 1% to about 2% of the suds suppressor in the composition, and the ratio of primary surfactant to suds suppressor ranges from about 4:1 to about 0.7:1, preferably from about 2:1 to about 1:1, and most preferably from about 1.5:1 to about 1:1.

The balance of the composition (1–99%) is water, preferably soft water in order to minimize the initial load on the sequestering builders.

A further discussion of the requirements and formulation of aqueous liquid cleaners is found in U.S. Pat. Nos. 3,679,608, issued to Aubert et al. on July 25, 1972, and 3,970,594, issued to Claybaugh on July 20, 1976. The foregoing two patents are hereby incorporated by reference herein.

Dishwashing Liquids

Dishwashing liquids are hard surface cleaning formulas which are particularly adapted to be diluted to levels of from about 0.1% to about 0.5% in water. The compositions are used to wash food stains from eating and cooking utensils. Such compositions are also frequently known to the art as light duty liquids. The requirements for a dishwashing liquid are that it must be effective against a wide variety of food stains, and must have a relatively high sudsing power, yet it must be sufficiently mild to allow one to use it in contact with one's hands on a daily basis without injuring one's skin. What follows is a description of the essential and optional ingredients of dishwashing liquids of the present invention.

The dishwashing liquids of the present invention contain from 1% to about 50% of appropriate surfactants. A preferred level of total surfactant in the composition is from 10% to 35% surfactant. The surfactants to be used are generally confined to anionic surfactants and nonionic surfactants.

Preferred anionic detergents for use in dishwashing liquid compositions are selected from the alkali metal, alkaline earth metal, and ammonium salts of inorganic anionic detergents selected from the following classes of detergents:

(1) alkyl benzene sulfonates in which the alkyl group contains from 9 to 15 carbon atoms in straight-chain or branched-chain configuration. Especially preferred alkyl benzene sulfonate is linear and includes an alkyl moiety having 12 carbon atoms.

(2) Alkyl sulfates obtained by sulfating an alcohol having 8 to 22 carbon atoms, preferably 10 to 16 carbon atoms. The alkyl sulfates have the formula $(ROSO_3)_2M$ where R is the $C_{8-22}$ alkyl group and M is the alkaline earth metal, alkali metal, or ammonium cation.

(3) Paraffin sulfonates having 8 to 22 carbon atoms, preferably 12 to 16 carbon atoms in the alkyl moiety.

(4) Olefin sulfonates having 8 to 22 carbon atoms, preferably 12 to 16 carbon atoms.

(5) Alkyl ether sulfates derived by ethoxylating an alcohol having 8 to 22 carbon atoms, preferably 12 to 16 carbon atoms with 1 to 30, preferably 1 to 12 moles of ethylene oxide.

(6) Alkyl glyceryl ether sulfonates having 8 to 22 carbon atoms, preferably 12 to 16 carbon atoms in the alkyl moiety; and (7) Mixtures thereof.

The above-described anionic detergents are all available commercially. The acid form of the anionic detergent may be converted to the alkaline earth metal, alkali metal or ammonium salt form either prior to admixture with the other ingredients or thereafter. The preferred cations for use herein are the sodium, potassium, magnesium, and ammonium cations, particularly the ammonium cations. Specific preferred surfactants are the ammonium salts of coconut alkyl sulfates, coconut alkyl ether sulfates containing an average of 3 ethylene oxide units per molecule surfactant.

The dishwashing liquids of the present invention may also contain semi-polar or nonpolar nonionic surfactants.

Semi-polar nonionic detergents useful herein include water-soluble amine oxides, phosphine oxides and sulfoxides described in the broad surfactant disclosure above.

Another nonionic detergent which is useful herein is an unsulfated alkoxylated alcohol corresponding to one of the alkyl ether sulfates previously described in connection with anionic surfactants useful herein.

Another nonionic surfactant useful herein may be selected from those aliphatic amides described above in the general surfactant disclosure.

The second essential ingredient of dishwashing liquids of the present invention is a tertiary alcohol having at least 5 carbon atoms in its molecular structure. Each of the specifically described tertiary alcohols in formulas (1) through (33) above are useful herein as the tertiary alcohol in order to improve the cleaning effect of the composition. A particularly preferred tertiary alcohol for use herein is 2,5-dimethyl-2,5-hexanediol. The tertiary alcohols are added to the composition at a level of from about 0.5% to about 40% of the composition.

A wide variety of optional ingredients may be added to dishwashing liquids of the present invention. The compositions may contain a solubilizing agent such as the alkali metal and ammonium salts of benzene, cumene, xylene, and toluene sulfonates. The alkalinity of the composition may be adjusted to a pH between about 7.0 and 9.0 by adding to the composition an alkaline material such as sodium or potassium hydroxide, ammonium hydroxide, or mono, di or trialkanolamines having from 1 to 5 carbon atoms in each alkanol moiety. To form a finished composition which is of suitable viscosity it is highly desirable to add a viscosity reducing agent to the composition. The primary viscosity reducing agent is water, which may be added at a level from about 20% to 90% by weight, preferably from about 20% to about 70% by weight, and most preferably from about 30% to 60% by weight. Other solvents which may be added to reduce the viscosity of the composition are the lower alkyl alcohols such as methanol, ethanol or isopropanol. Such solvents preferably comprise about 2% to about 10% by weight of the composition. Alkali metal, alkaline earth metal, or ammonium salts may be added to the composition to provide a preferred cation to the composition. Addition of these salts is particularly desired in the event that an alkali metal surfactant is used in the composition, but certain of the properties of a magnesium or calcium surfactant are desired in the composition. It may also be desirable to incorporate in the composition coloring agents, opacifiers, perfumes, corrosion inhibitors, small amounts of heavy metal chelating agents such as salts of citric acid or ethylene diamine tetracetic acid, and so forth.

EXAMPLES

A simulated bathtub soil (BTS) is prepared as follows:

Soil A is prepared by admixing acids, fatty esters, paraffin wax, unsaturated hydrocarbons and natural oils in proportions which simulate human body soils.

Soil B is prepared from clay soil, humus, silica, iron oxides, carbon black, and protein and fatty soils as binders.

Twenty grams of soap, 4 grams of soil A and 2 grams of soil B are high shear mixed with 1 gallon of water at 100° F. for 30 minutes. The mix is then poured into a separatory funnel and 50 ml of water hardness concentrate (37,250 ppm $Ca^{++}$, 7,680 ppm $Mg^{++}$) is added. The water hardness will cause precipitation; the precipitate is separated from the water by decanting.

The BTS soil is applied with a small paint roller to a nonacid resistant porcelain plate, previously etched with 10% citric acid solution for 10 minutes at room temperature. Only one coat is applied. (A coat is applied with a single stroke of the roller.) The plate is baked at 130° C. for 15 minutes and the plate is allowed to cool. A second coat is applied, the baking step is repeated, the plate is allowed to cool and is ready for use in cleaning tests.

A calcium stearate soil (CaSt) is then prepared as follows:

Into 250 grams of isopropyl alcohol is placed 75 grams of the calcium salt of stearic acid. The mixture is stirred (magnetic stirrer) and 0.5 grams of finely divided charcoal is added. The material is stirred until the charcoal is well blended.

The calcium stearate solution is rolled onto a smooth porcelain plate and baked at 190° C. for 20 minutes. After cooling, the plate is ready for use in cleaning tests.

Cleaning of Bathtub and Calcium Stearate Soils

A Gardner Model M-105-A Washability Machine, a device for mechanically passing a sponge across a flat surface in a uniform and reproducible manner, is used for Bathtub (BTS) and Calcium Stearate (CaSt) soil removal testing. A sponge is moistened with 30 grams of water and from 2 to 5 grams of product; for CaSt a weight (1000 g) is added to the sponge carriage.

The same number of strokes is used with each test. After cleaning the porcelain plates are allowed to dry and are visually graded by three human graders according to a 0–4 scale versus a control formulation. The scale numbers are related to verbal descriptions as follows:

0=No difference
1=I think there is a difference
2=I know there is a difference
3=There is a large difference
4=There is a very large difference

EXAMPLE I

A liquid abrasive cleanser of the following composition was prepared:

| Component | Wt. % |
|---|---|
| Sodium Hypochlorite | 1.0 |
| Gelwhite GP (Sodium Montmorillonite Clay)* | 3.2 |
| Calcium Pyrophosphate (Particle Size 20) | 8.0 |
| Sodium Paraffin Sulfonate | 2.0 |
| 1-Methylcyclohexanol | 2.0 |
| Sodium Fluoride | 1.0 |
| Potassium Carbonate (Buffering Agent) | 7.0 |
| Potassium Bicarbonate | 0.6 |
| Perfume, Color | 0.25 |
| Soft Water | Balance |
| Composition pH | 11.25 |

*Sold by Southern Clay, Inc., Gonzales, Texas.

A total of 32 parts of Gelwhite GP, 501 parts of soft water and 20 parts of 1-methylcyclohexanol were admixed using relatively high shear agitation to the extent necessary to form a false-body composition, generally about 7–8 minutes.

Under moderate shear mixing the following were added, in order, to the false-body composition: 80 parts of calcium pyrophosphate abrasive; 148 parts of a 47.5% solution of potassium carbonate; 2.5 parts of perfume and color; 67 parts of a 30% solution of sodium paraffin sulfonate; 10 parts of sodium fluoride; 82 parts of a 12% solution of sodium hypochlorite; 6 parts of potassium bicarbonate and 46 parts of soft water.

When this composition was tested for removal of BTS and CaSt soil, it was found to remove these soils much better than did a composition in which 1-methylcyclohexanol was replaced weight for weight by soft water.

EXAMPLE II

A powdered nonabrasive cleanser of the following composition was prepared:

| Component | Wt. % |
|---|---|
| Sodium Tripolyphosphate | 20.0 |
| Trisodium Phosphate | 20.0 |
| 2,5-Dimethyl-2,5-hexanediol (DMHD) | 20.0 |
| Sodium Sesquicarbonate | 37.8 |
| LAS | 0.9 |
| Sodium Sulfate | 1.3 |
| | 100.0% |

All components were of a particle size such that they passed through a 12 mesh Tyler screen (10 mesh U.S. Standard Screen).

The materials were admixed by sealing in a jar and vigorously shaking by hand for a minute. To ensure adequate mixing, samples were riffled prior to cleaning tests. The instant composition removed BTS and CaSt much better than one in which the DMHD was replaced weight for weight by sodium sesquicarbonate.

EXAMPLE III

A powdered abrasive cleanser of the following composition was prepared by mixing a total of 50 pounds of the following ingredients in a 50 lb. can mixer for at least 5 minutes:

| Component | Wt. % |
|---|---|
| $SiO_2$ Sand (0.1 to 200μ particle size) | 76.2 |
| 2,5-Dimethyl-2,5-hexanediol (DMHD) | 2.0 |
| LAS | 2.3 |

-continued

| Component | Wt. % |
|---|---|
| Sodium Carbonate | 12.5 |
| Sodium Acetate | 3.5 |
| Calcium Hydroxide | 0.8 |
| Sodium Dichlorocyanurate | 1.1 |
| Sodium Sulfate | 1.6 |
| | 100.0% |

The instant composition removed BTS and CaSt soil much better than one in which the DMHD is replaced weight for weight by silica ($SiO_2$) sand.

EXAMPLE IV

A liquid hard surface cleaner of the following composition was prepared:

| Component | Wt. % |
|---|---|
| Soft Water | 69.41 |
| Sodium Cumene Sulfonate | 7.00 |
| Sodium Carbonate | 1.55 |
| Sodium Bicarbonate | 1.25 |
| Coconut Fatty Acid (average chain length $C_{12}$) | 0.60 |
| LAS, Sodium Salt | 3.20 |
| Tetrapotassium Pyrophosphate | 13.81 |
| Sodium Sulfite | 0.25 |
| Ammonium Hydroxide | 0.93 |
| 2-Phenyl-2-Propanol | 2.00 |
| | 100.00 |

The instant composition was prepared by admixing at 100° F., in order, the soft water, sodium cumene sulfonate, sodium carbonate, sodium bicarbonate, coconut fatty acid, LAS, tetrapotassium pyrophosphate, sodium sulfite, ammonium hydroxide, and 2-phenyl-2-propanol. After the last ingredient was added the mixture was stirred for five minutes.

The instant composition removed BTS and CaSt soils much better than did a composition in which 2-phenyl-2-propanol was replaced with an equal weight of soft water.

EXAMPLE V

A liquid dishwashing detergent was prepared by admixing the following ingredients:

| Component | Wt. % |
|---|---|
| Ammonium Xylene Sulfonate | 2.50 |
| Coconut Dimethylamine Oxide | 4.00 |
| Ethanol | 6.25 |
| Ammonium Coconut Alkyl Sulfate | 12.50 |
| Ammonium Coconut Alkyl Triethoxysulfate | 13.50 |
| Water | 51.25 |
| 2,5-Dimethyl-2,5-hexanediol | 10.00 |
| | 100.00% |

The instant composition was dissolved in water to afford a 0.4% solution. An egg-soiled coupon was soaked at 115° F. for 15 minutes in this solution, then cleaned with a Gardner Washability Machine. A large advantage was seen for the instant composition versus one in which the 2,5-dimethyl-2,5-hexanediol is replaced weight for weight with water.

What is claimed is:

1. A detergent composition consisting essentially of:

A. 0.05% to 50% of a surfactant selected from the group consisting of anionic, cationic, nonionic, zwitterionic, and amphoteric surfactants; and B. 0.5% to 50% of a tertiary alcohol having at least 5 carbon atoms and less than 100 carbon atoms per molecules, said tertiary alcohol being selected from the group consisting of:

(A) heterosubstituted or unsubstituted monohydric alcohols having the following molecular structure:

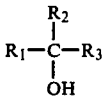

wherein $R_1$, $R_2$ and $R_3$ contain from 1 to about 20 carbon atoms and are selected from a subgroup consisting of alkyl, cycloalkyl, carboxyl, carboxylate salt, ester, carbonyl, ether, nitrile, aryl, aralkyl, alkaryl, and aldehyde moieties, and combinations thereof;

(B) unsubstituted alcohols having the following molecular structure:

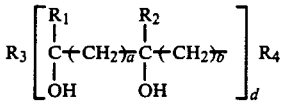

wherein $R_1$, $R_2$ and $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof, $R_4$ is selected from the same group as $R_1$, a is from 0 to about 8, b is from 0 to about 8, d is from 1 to about 4, and the values of a and b are separately selected for each repetition of d, if d is greater than 1;

(C) heterosubstituted or unsubstituted alicyclic alcohols having the following molecular structure:

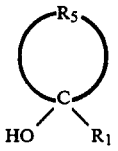

wherein $R_1$ contains from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_5$ is a substituted or unsubstituted cyclic chain of 2 to 20 carbon atoms;

(D) hetero unsubstituted alicyclic alcohols having the following structure:

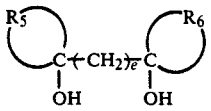

wherein $R_5$ is as defined above, $R_6$ is selected from the same group as $R_5$, and e is 1 to about 8;

(E) heterosubstituted or unsubstituted alcohols having the following structure:

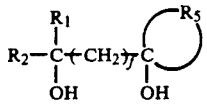

wherein $R_1$, $R_2$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties; and combinations thereof; $R_5$ is as defined above and f is 0 to about 8;

(F) heterosubstituted or unsubstituted alcohols having the following structure:

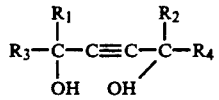

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_4$ is as defined above; and (G) heterosubstituted or unsubstituted alcohols having the following structure:

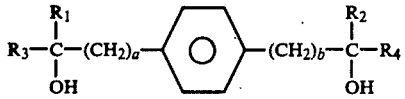

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and the aldehyde moieties, and combinations thereof; $R_4$, a, and b are defined above.

2. The composition of claim 1, wherein said tertiary alcohol is a liquid and has a molecular structure selected from the group consisting of:

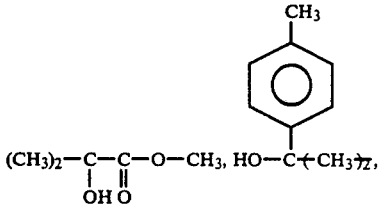

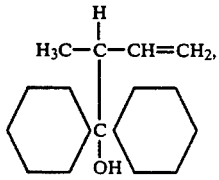

-continued

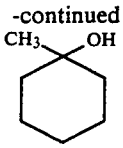

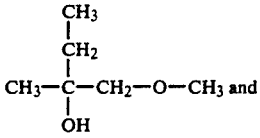

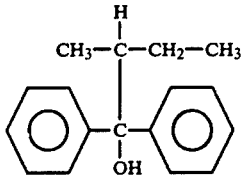

3. The composition of claim 1, wherein said tertiary alcohol has a melting point of at least 35° Celsius, solubility in water of at least 0.1% by weight, and a molecular structure selected from a group consisting of:

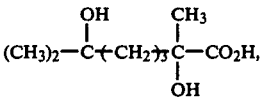

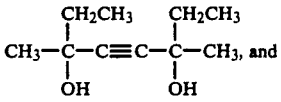

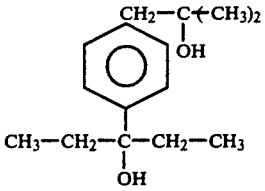

4. The composition of claim 1, wherein said tertiary alcohol is selected from the tertiary alcohols of A through E; $R_1$, $R_2$, $R_3$ and $R_4$ are alkyl moieties; $R_5$ and $R_6$ are cycloalkyl moieties; and the selected tertiary alcohol is stable in compositions which contain from 0.1% to 5% of a source of hypochlorite ions.

5. The composition of claim 4, wherein said tertiary alcohol has a structure selected from a group consisting of:

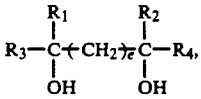

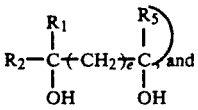

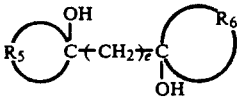

wherein $R_1$, $R_2$, $R_3$, $R_4$, $R_5$, $R_6$ and e are as defined in claim 4 and wherein said tertiary alcohol is further characterized by a melting point of at least 35° Celsius and a solubility in water of at least 0.1% by weight at 20° Celsius.

6. The composition of claim 4, wherein said tertiary alcohol is a liquid having a structure selected from the group consisting of:

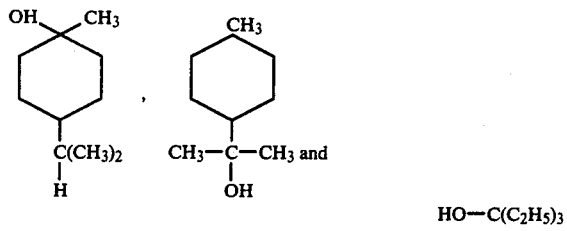

7. The composition of claim 5, wherein said tertiary alcohol has a molecular structure selected from a group consisting of:

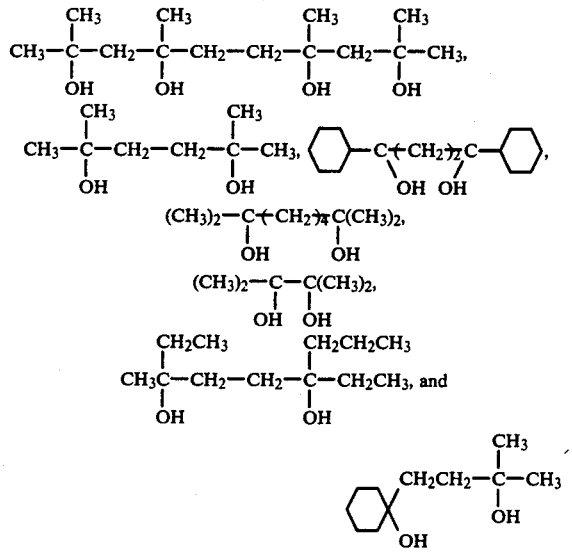

8. The composition of claim 7, wherein said tertiary alcohol is 2,5-dimethyl-2,5-hexanediol.

9. The composition of claims 4, 5, 6, or 7, further comprising 0.1% to 5% of a source of hypochlorite ions.

10. A liquid abrasive cleanser consisting essentially of:

A. 0.05% to 10% of a surfactant;

B. 0.05% to 40% of a tertiary alcohol having at least 5 carbon atoms and less than 100 carbon atoms, said alcohol being selected from the group consisting of:

(A) heterosubstituted or unsubstituted monohydric alcohols having the following molecular structure:

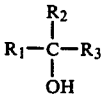

wherein $R_1$, $R_2$ and $R_3$ contain from 1 to about 20 carbon atoms and are selected from a subgroup consisting of alkyl, cycloalkyl, carboxyl, carboxylate salt, ester, carbonyl, ether, nitrile, aryl, aralkyl, alkaryl, and aldehyde moieties, and combinations thereof;

(B) unsubstituted alcohols having the following molecular structure:

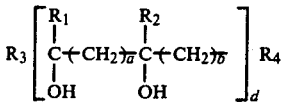

wherein $R_1$, $R_2$ and $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof, $R_4$ is selected from the same group as $R_1$, a is from 0 to about 8, b is from 0 to about 8, d is from 1 to about 4, and the values of a and b are separately selected for each repetition of d, if d is greater than 1;

(C) heterosubstituted or unsubstituted alicyclic alcohols having the following molecular structure:

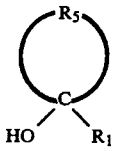

wherein $R_1$ contains from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_5$ is a substituted or unsubstituted cyclic chain of 2 to 20 carbon atoms;

(D) hetero unsubstituted alicyclic alcohols having the following structure:

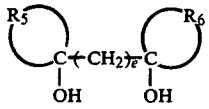

wherein $R_5$ is as defined above, $R_6$ is selected from the same group as $R_5$, and e is 1 to about 8;

(E) heterosubstituted or unsubtituted alcohols having the following structure:

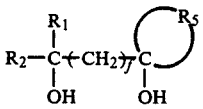

wherein $R_1$, $R_2$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_5$ is as defined above and f is 0 to about 8;

(F) heterosubstituted or unsubstituted alcohols having the following structure:

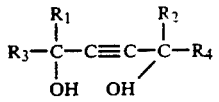

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_4$ is as defined above; and (G) heterosubstituted or unsubstituted alcohols having the following structure:

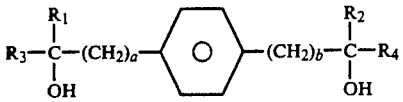

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_4$, a, and b are defined above;

C. 1% to 65% of a substantially water-insoluble abrasive material having particle size diameters ranging from about 1 to about 250 microns, and a specific gravity of about 0.2 to 2.2; and D. 10% to 95% water.

11. A powdered abrasive cleanser consisting essentially of:

A. 0.1% to 6% of a surfactant;

B. 0.5% to 40% of a tertiary alcohol having at least 5 carbon atoms and less than 100 carbon atoms, said alcohol being selected from the group consisting of:

(A) heterosubstituted or unsubstituted monohydric alcohols having the following molecular structure:

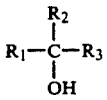

wherein $R_1$, $R_2$ and $R_3$ contain from 1 to about 20 carbon atoms and are selected from a subgroup consisting of alkyl, cycloalkyl, carboxyl, carboxylate salts, ester, carbonyl, ether, nitrile, aryl, aralkyl, alkaryl, and aldehyde moieties, and combinations thereof;

(B) unsubstituted alcohols having the following molecular structure:

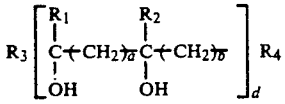

wherein $R_1$, $R_2$ and $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof, $R_4$ is selected from the same group as $R_1$, a is from L0 to about 8, b is from 0 to about 8, d is from 1 to about 4, and the values of a and b are separately selected for each repetition of d, if d is greater than 1;

(C) heterosubstituted or unsubstituted alicyclic alcohols having the following molecular structure:

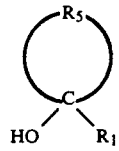

wherein $R_1$ contains from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl and aldehyde moieties, and combinations thereof; $R_5$ is a substituted or unsubstituted cyclic chain of 2 to 20 carbon atoms;

(D) hetero unsubstituted alicyclic alcohols having the following structure:

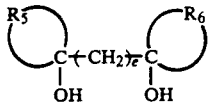

wherein $R_5$ is as defined above, $R_6$ is selected from the same group as $R_5$, and e is 1 to about 8;

(E) heterosubstituted or unsubtituted alcohols having the following structure:

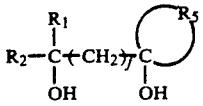

wherein $R_1$, $R_2$ contain from 1 to about 20 carbon atoms and are selected from a subgroup consisting of alky, alkenyl, alkynyl, cycloalkyl, carboxyl, carboxylate salt, ester, carbonyl, ether, nitrile, aryl, aralkl, alkaryl, and aldehye moieties, and combinations thereof, $R_5$ is as defined above and f is 0 to about 8;

(F) heterosubstituted or unsubstituted alcohols having the following stucture:

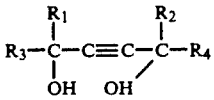

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_4$ is as defined above; and (G) heterosubstituted or unsubstituted alcohols having the following structure:

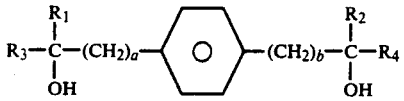

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_4$, a, and b are defined above;

C. 20% to 95% of a water-insoluble abrasive material having particle size diameters ranging from about 0.3 to about 0.001 millimeters.

12. A powdered water dispersible cleanser consisting essentially of:

A. 0.9% to 20% of a surfactant; p1 B. 0.5% to 20% of a tertiary alcohol having at least 5 carbon atoms and less than 100 carbon atoms, said alcohol being selected from the group consisting of:

(A) heterosubstituted or unsubstituted monohydric alcohols having the following molecular structure:

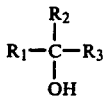

wherein $R_1$, $R_2$ and $R_3$ contain from 1 to about 20 carbon atoms and are selected from a subgroup consisting of alkyl, cycloalkyl, carboxyl, carboxylate salt, ester, carbonyl, ether, nitrile, aryl, aralkyl, alkaryl, and aldehyde moieties, and combinations thereof;

(B) unsubstituted alcohols having the following molecular structure:

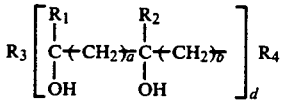

wherein $R_1$, $R_2$ and $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof, $R_4$ is selected from the same group as $R_1$, a is from 0 to about 8, b is from 0 to about 8, d is from 1 to about 4, and the values of a and b are separately selected for each repetition of d, if d is greater than 1;

(C) heterosubstituted or unsubstituted alicyclic alcohols having the following molecular structure:

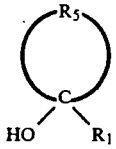

wherein $R_1$ contains from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_5$ is a substituted or unsubstituted cyclic chain of 2 to 20 carbon atoms;

(D) hetero unsubstituted alicyclic alcohols having the following stucture:

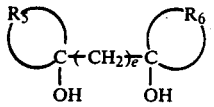

wherein $R_5$ is as defined above, $R_6$ is selected from the same group as $R_5$, and e is 1 to about 8, (E) heterosubstituted or unsubstituted alcohols having the following structure:

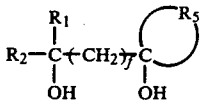

wherein $R_1$, $R_2$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_5$ is as defined above and f is 0 to about 8;

(F) heterosubstituted or unsubstituted alcohols having the following structure:

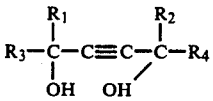

wherein $R_1$, $R_2$, $R_3$ contain from 1 to about 20 carbon atoms and are selected from a subgroup consisting of alkyl, alkenyl, alkynyl, cycloalkyl, carbxyl, carboxylate salt, ester, carbonyl, ether, nitrile, aryl, aralkyl, alkaryl, and aldehyde moieties, and combinations thereof; $R_4$ is as defined above; and (G) heterosubstituted or unsubtituted alcohols having the following structure:

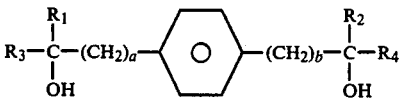

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_4$, a, and b are defined above;

C. 0.5% to 99% of at least one builder salt.

13. An aqueous liquid cleaner consisting essentially of:

A. 0.5% to 20% of a surfactant;

B. 0.5% to 20% of a tertiary alcohol having at least 5 carbon atoms and less than 100 carbon atoms, said alcohol being selected from the group consisting of:

( A) heterosubstituted or unsubstituted monohydric alcohols having the following molecular structure:

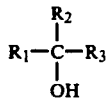

wherein $R_1$, $R_2$ and $R_3$ contain from 1 to about 20 carbon atoms and are selected from a subgroup consisting of alkyl, cycloalkyl, carboxyl, carboxylate salt, ester, carbonyl, ether, nitrile, aryl, aralkyl, alkaryl, and aldehyde moieties, and combinations thereof;

(B) unsubstituted alcohols having the following molecular structure:

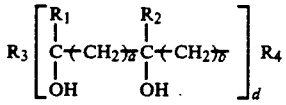

wherein $R_1$, $R_2$ and $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof, $R_4$ is selected from the same group as $R_1$, a is from 0 to about 8, b is from 0 to about 8, d is from 1 to about 4, and the values of a and b are separately selected for each repetition of d, if d is greater than 1;

(C) heterosubstituted or unsubstituted alicyclic alcohols having the following molecular structure:

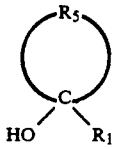

wherein $R_1$ contains from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_5$ is a substituted or unsubstituted cyclic chain of 2 to 20 carbon atoms;

(D) hetero unsubstituted alicyclic alcohols having the following structure:

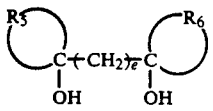

wherein $R_5$ is as defined above, $R_6$ is selected from the same group as $R_5$, and e is 1 to about 8;

(E) heterosubstituted or unsubstituted alcohols having the following structure:

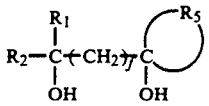

wherein $R_1$, $R_2$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_5$ is as defined above and f is 0 to about 8;

(F) heterosubstituted or unsubstituted alcohols having the following structure:

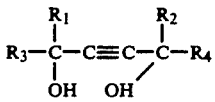

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_4$ is as defined above; and (G) heterosubstituted or unsubtituted alcohols having the following structure:

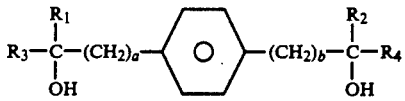

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_4$, a, and b are defined above;

C. 0.5% to 80% of a builder salt.

14. A dishwashing liquid consisting essentially of:

A. 1% to 50% of a surfactant selected from the group consisting of anionic and nonionic surfactants;

B. 0.5% to 40% of a tertiary alcohol having at least 5 carbon atoms and less than 100 carbon atoms, said alcohol being selected from the group consisting of:

(A) heterosubstituted or unsubstituted monohydric alcohols having the following molecular structure:

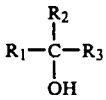

wherein $R_1$, $R_2$ and $R_3$ contain from 1 to about 20 carbon atoms and are selected from a subgroup consisting of alkyl, cycloalkyl, carboxyl, carboxylate salt, ester, carbonyl, ether, nitrile, aryl, aralkyl, alkaryl, and aldehyde moieties, and combinations thereof;

(B) unsubstituted alcohols having the following molecular structure:

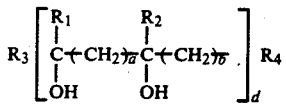

wherein $R_1$, $R_2$ and $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof, $R_4$ is selected from the same group as $R_1$, a is from 0 to about 8, b is from 0 to about 8, is from 1 to about 4, and the values of a and b are separately selected for each repetition of d, if d is greater than 1;

(C) heterosubstituted or unsubstituted alicyclic alcohols having the following molecular structure:

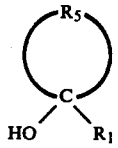

wherein $R_1$ contains from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_5$ is a substituted or unsubstituted cyclic chain of 2 to 20 carbon atoms;

(D) hetero unsubstituted alicyclic alcohols having the following structure:

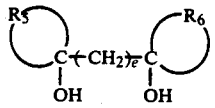

wherein $R_5$ is as defined above, $R_6$ is selected from the same group as $R_5$, and e is 1 to about 8;

(E) heterosubstituted or unsubtituted alcohols having the following structure:

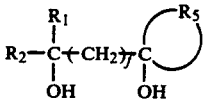

wherein $R_1$, $R_2$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_5$ is as defined above and f is 0 to about 8;

(F) heterosubstituted or unsubstituted alcohols having the following structure:

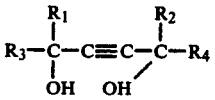

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_4$ is as defined above; and (G) heterosubstituted or unsubtituted alcohols having the following structure:

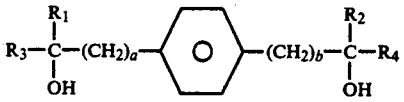

wherein $R_1$, $R_2$, $R_3$ contain from 1 to about 20 carbon atoms and are selected from a subgroup consisting of alkyl, alkenyl, alkynyl, cycloalkyl, carboxyl, carboxylate salt, ester, carbonyl, ether, nitrile, aryl, aralkyl, alkaryl, and aldehyde moieties, and combinations thereof; $R_4$, a, and b are defined above;

C. 20% to 90% water.

* * * * *

UNITED STATES PATENT AND TRADEMARK OFFICE

CERTIFICATE OF CORRECTION

PATENT NO. : 4,287,080

DATED : September 1, 1981

INVENTOR(S) : Michael P. Siklosi

It is certified that error appears in the above-identified patent and that said Letters Patent are hereby corrected as shown below:

Column 8, line 37, "hetadecyldimethylamine" should read -- heptadecyldimethylamine --.

Column 32, line 3, delete -- L --.

Column 33, line 20, delete -- pl --.

Column 37, line 20, after second comma and before "is" insert -- d --.

Signed and Sealed this

Ninth Day of March 1982

[SEAL]

*Attest:*

GERALD J. MOSSINGHOFF

*Attesting Officer* *Commissioner of Patents and Trademarks*